US007311306B2

(12) United States Patent
Chuang

(10) Patent No.: US 7,311,306 B2
(45) Date of Patent: Dec. 25, 2007

(54) EXTENDABLE CYLINDRICAL JIGSAW PUZZLE

(76) Inventor: Shih-Hung Chuang, 14F-2, No. 343, Chungho Rd., Yungho City, Taipei Hsien (TW)

( * ) Notice: Subject to any disclaimer, the term of this patent is extended or adjusted under 35 U.S.C. 154(b) by 60 days.

(21) Appl. No.: 11/334,654

(22) Filed: Jan. 16, 2006

(65) Prior Publication Data

US 2007/0164514 A1 Jul. 19, 2007

(51) Int. Cl.
*A63F 9/08* (2006.01)

(52) U.S. Cl. ..... 273/153 S

(58) Field of Classification Search ..... 273/157 R, 273/153 S, 156
See application file for complete search history.

(56) References Cited

U.S. PATENT DOCUMENTS 4,949,969 A * 8/1990 Johnson ..... 273/153 S
5,074,561 A * 12/1991 Johnson ..... 273/153 S
5,116,053 A * 5/1992 Blankenburg et al. ... 273/153 S
5,429,364 A * 7/1995 Chang ..... 273/153 S
5,845,904 A * 12/1998 Hawkins ..... 273/153 S
7,021,625 B2 * 4/2006 Simmons ..... 273/157 R
D532,834 S * 11/2006 Chuang ..... D21/478
7,147,224 B2 * 12/2006 Chuang ..... 273/153 S

* cited by examiner

*Primary Examiner*—Steven Wong
(74) *Attorney, Agent, or Firm*—James H. Walters

(57) ABSTRACT

A cylindrical jigsaw puzzle includes a bottom rim having an outer flange, an inner flange and a first gap between the outer flange and the inner flange, a top rim having a ring body, a positioning flange extending from an inner face of the ring body and a second gap defined between the ring body and the positioning flange, top puzzle pieces each having a first assembly edge corresponding to and received in the second gap of the top rim and bottom puzzle pieces each having a second assembly edge corresponding to and received in the first gap of the bottom rim. Combination among the top puzzle pieces with the top rim mounted thereon, bottom puzzle pieces with the bottom rim mounted thereunder and a cap mounted on top of the top rim is able to accomplish a cylinder.

8 Claims, 8 Drawing Sheets

EXTENDABLE CYLINDRICAL JIGSAW PUZZLE

BACKGROUND OF THE INVENTION

1. Field of the Invention

The present invention relates to a cylindrical jigsaw puzzle, and more particularly to an extendable cylindrical jigsaw puzzle.

2. Description of Related Art

After a common cylindrical jigsaw puzzle is completed, due to mutual combination between two adjacent arcuate puzzle pieces, the cylindrical jigsaw puzzle is able to stand on its own on a surface. However, because the overall structural relationship depends on the mutual complementarily arms and cutouts from two adjacent puzzle pieces, top edge and bottom edge of the cylindrical jigsaw puzzle are structurally weak because there is no support thereto such that when an impact is applied to the top edge and bottom edge, the cylindrical jigsaw puzzle is easily destroyed or damaged.

To overcome the shortcoming of the conventional cylindrical jigsaw puzzle, an improved cylindrical jigsaw puzzle is introduced to the market and has frames for the top edge and bottom edge of the cylindrical jigsaw puzzle so that the structural strength of the conventional cylindrical jigsaw puzzle is enhanced.

Having the frames for the top edge and bottom edge of the cylindrical jigsaw puzzle does increase the structural strength of the jigsaw puzzle, but the extension of the jigsaw puzzle is limited. That is, after the frames are added to the jigsaw puzzle, the jigsaw puzzle is not able to extend its application and thus the structure thereof is fixed. Should there be different requirements for the conventional cylindrical jigsaw puzzle, it is impossible for the conventional jigsaw puzzle to fulfill the requirements.

To overcome the shortcomings, the present invention tends to provide an improved cylindrical jigsaw puzzle to mitigate the aforementioned problems.

SUMMARY OF THE INVENTION

The primary objective of the present invention is to provide a cylindrical jigsaw puzzle having multiple puzzles pieces, a bottom rim, a top rim and an optional cap selectively mounted on top of the top rim such that the cylindrical jigsaw puzzle is able to extend its application depending whether the cap is mounted on the top rim.

In one aspect of the present invention, the puzzle pieces are divided into top puzzle pieces, mediate puzzle pieces and bottom puzzle pieces. Each top puzzle piece has an assembly edge, a step formed on a face adjacent to the assembly edge, two connection arms respectively extending from two opposed sides of the top puzzle piece and a cutout defined in a side face opposed to the side face where the assembly edge is formed. Also, each bottom puzzle piece has an assembly edge, a step formed on a face adjacent to the assembly edge, two connection arms respectively extending from two opposed sides of the bottom puzzle piece and a cutout defined in a side face opposed to the side face where the assembly edge is formed.

In yet another aspect of the present invention, the top puzzle piece or the bottom puzzle piece has a recessed area defined in a rear side face of the top puzzle piece or the bottom puzzle piece.

A further aspect of the present invention is that the bottom rim has an outer flange, an inner flange integrally formed with the outer flange and a first gap defined between the outer flange and the inner flange. Multiple clamping pieces are formed on the inner flange and each clamping piece has a boss formed on an outer face of the clamping piece. The top rim has a positioning flange extending downward from the top rim and an extension flange extending upward from the top rim. The positioning flange has multiple positioning pieces formed on the positioning flange and respectively having a positioning rib formed on an outer face of the respective positioning piece. The extension flange has first securing ribs formed on an outer periphery of the extension flange. The cap has an open end and a closed end having an elongated hole defined through the closed end. The cap further has second securing ribs formed on an inner peripheral wall of the cap to correspond to the first securing ribs.

Other objects, advantages and novel features of the invention will become more apparent from the following detailed description when taken in conjunction with the accompanying drawings.

DETAILED DESCRIPTION OF THE PREFERRED EMBODIMENT

Figure 1:
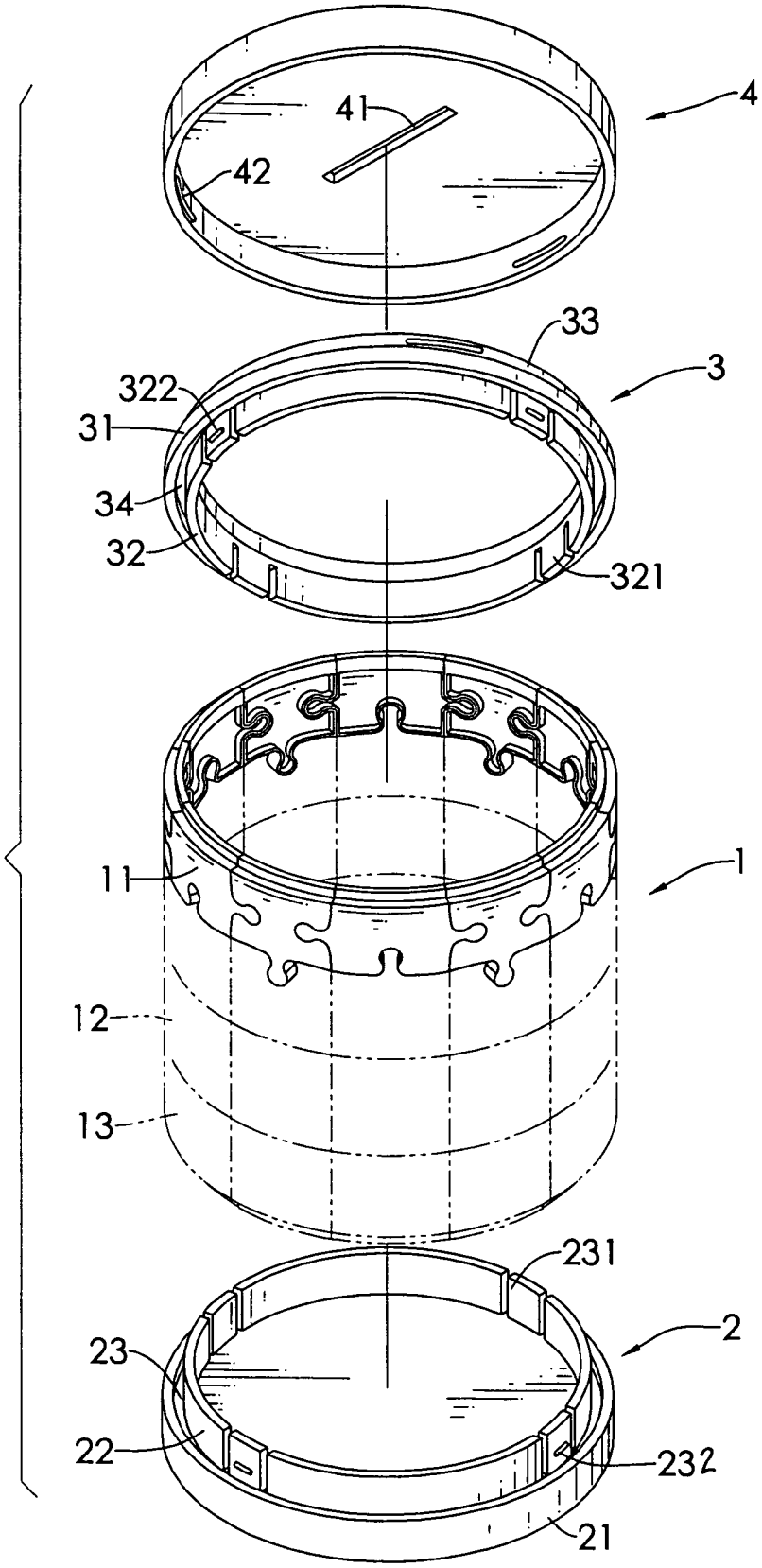
FIG. 1 is an exploded perspective view of the cylindrical jigsaw puzzle of the present invention.

With reference to FIG. 1, it is noted that the cylindrical jigsaw puzzle of the present invention includes puzzle pieces (1), a bottom rim (2), a top rim (3) and an optional cap (4) selectively mounted on top of the top rim (3) such that the cylindrical jigsaw puzzle is able to extend its application depending whether the cap (4) is mounted on the top rim.

The bottom rim (2) has a closed end and an open end and is composed of an outer flange (21), an inner flange (22) integrally formed with the outer flange (21) and a first gap (23) defined between the outer flange (21) and the inner flange (22). Multiple clamping pieces (231) are formed on the inner flange (22) and each clamping piece (231) has a boss (232) formed on an outer face of the clamping piece (231).

The top rim (3) is composed of a ring body (31), a positioning flange (32) extending downward from an inner face of the ring body (31) and an extension flange (33) extending upward from the inner face of the ring body (31) of the top rim (3). The positioning flange (32) has multiple positioning pieces (321) formed on the positioning flange (32) and respectively having a positioning rib (322) formed on an outer face of the respective positioning piece (321). The extension flange (33) has first securing ribs (331)

formed on an outer periphery of the extension flange (33) and oblique to a central axis of the top rim (3).

The cap (4) has an open end and a closed end. A skirt is extending down from a peripheral edge of the closed end and has second securing ribs (42) formed on an inner face of the skirt and oblique to a central axis of the cap (4). An elongated hole (41) is defined through the closed end of the cap (4).

Figure 2A:
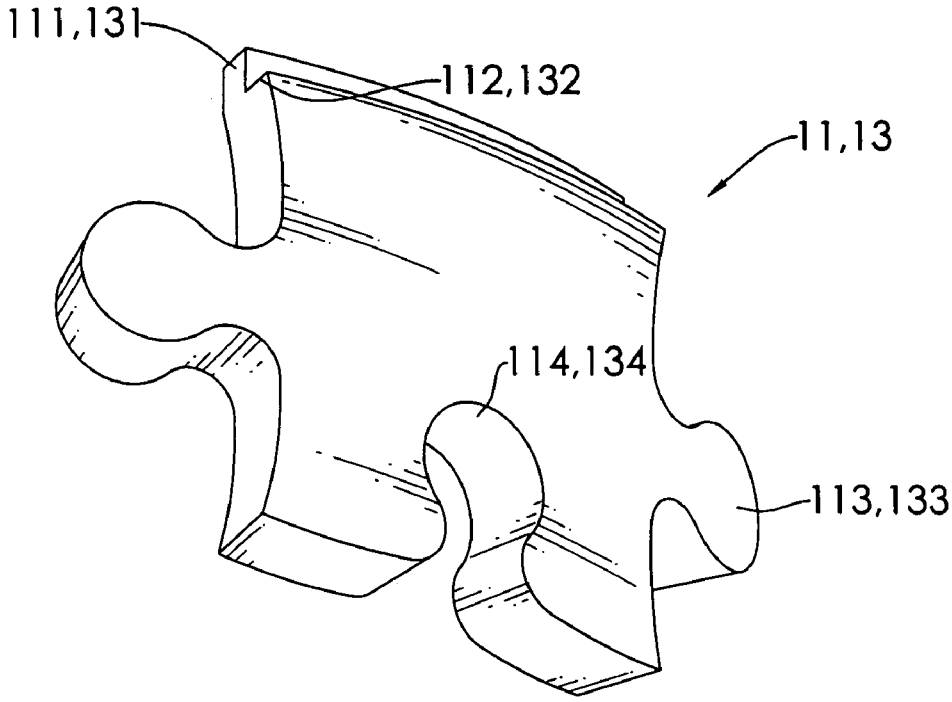
FIGS. 2A and 2B are perspective views showing structure of both the top puzzle piece and the bottom puzzle piece.
Figure 2B:
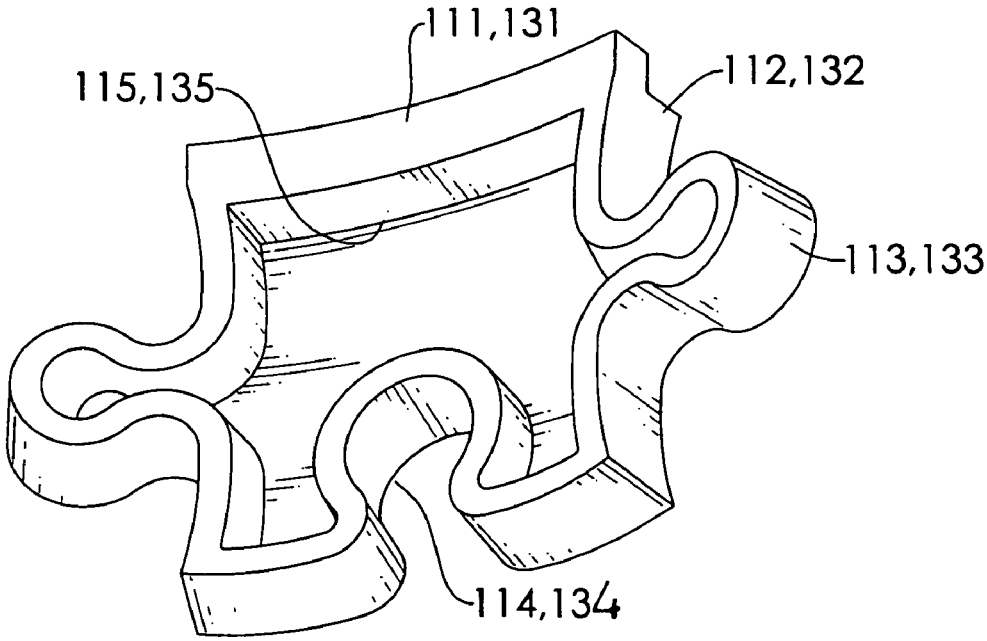

With reference to FIGS. 2A and 2B, the puzzle pieces (1) are divided into top puzzle pieces (11), mediate puzzle pieces (12) and bottom puzzle pieces (13). Each top puzzle piece (11) has an assembly edge (111), a step (112) formed on a face adjacent to the assembly edge (111), two connection arms (113) respectively extending from two opposed sides of the top puzzle piece (11) and a cutout (114) defined in a side face opposed to the side face where the assembly edge (111) is formed. Also, each bottom puzzle piece (13) has an assembly edge (131), a step (132) formed on a face adjacent to the assembly edge (131), two connection arms (133) respectively extending from two opposed sides of the bottom puzzle piece (13) and a cutout (134) defined in a side face opposed to the side face where the assembly edge (132) is formed.

Furthermore, the top puzzle piece (11) as well as the bottom puzzle piece (13) has a recessed area (115,135) defined in a rear side face of the top puzzle piece (11) and the bottom puzzle piece (13). It is to be noted that a thickness from a bottom face defining the recessed area (115,135) to a top face of the assembly edge (111,131) is substantially the same as a distance between a bottom face of the positioning piece (321) to the positioning rib (322) or between a top face of the clamping piece (231) to the boss (232) such that when the top puzzle piece (11) is inserted into the second gap (34) of the top rim (3), the positioning ribs (322) are able to abut a bottom face opposite to the assembly edge (115). Also, when the bottom puzzle piece (130 is inserted into the first gap (23) of the bottom rim (2), the bosses (232) are able to abut a bottom face opposite to the assembly edge (131) of the bottom puzzle piece (13).

Figure 3A:
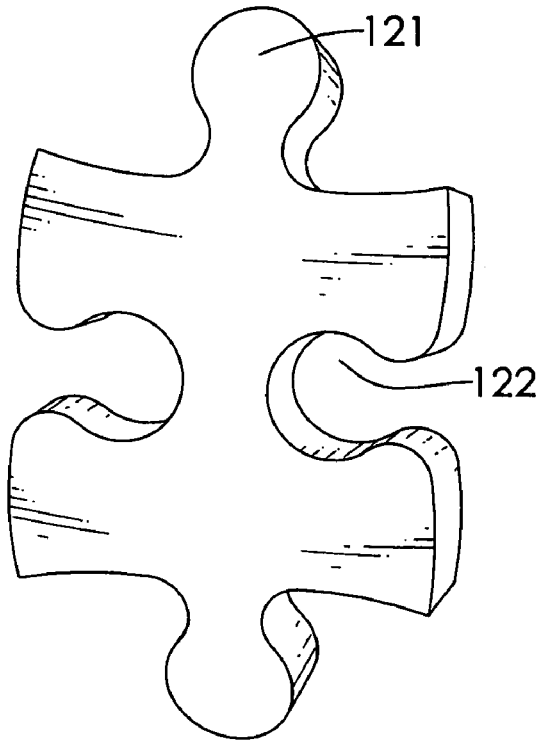
FIGS. 3A and 3B are perspective views showing structure of a mediate puzzle piece.
Figure 3B:
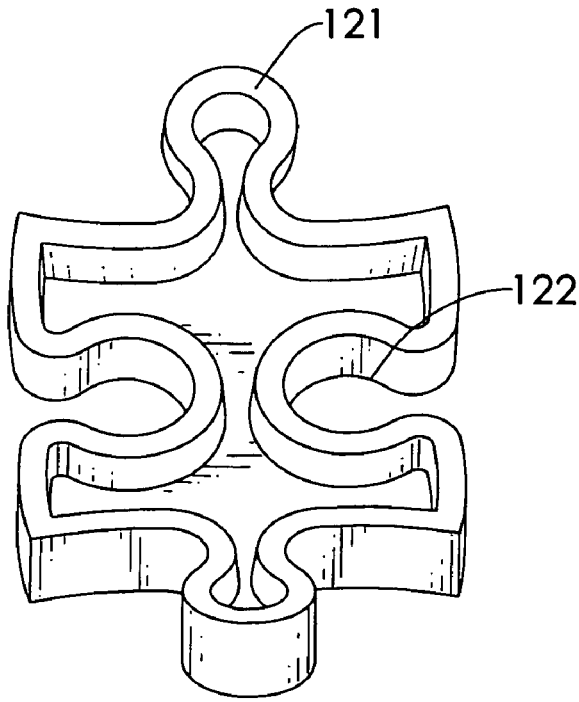

With reference to FIGS. 3A and 3B, it is noted that the mediate puzzle piece (12) has extension arms (121) opposed extending from opposite sides thereof to be complementary to the cutouts (114,134) of both the top puzzle piece (11) and the bottom puzzle piece (13) and connection cutouts (122) opposed defined in opposite sides thereof to be complementary to both the top puzzle piece (11) and the bottom puzzle piece (13). Also, each mediate puzzle piece (12) has a thickness the same as that of the top puzzle piece (11) and the bottom puzzle piece (13).

Figure 4:
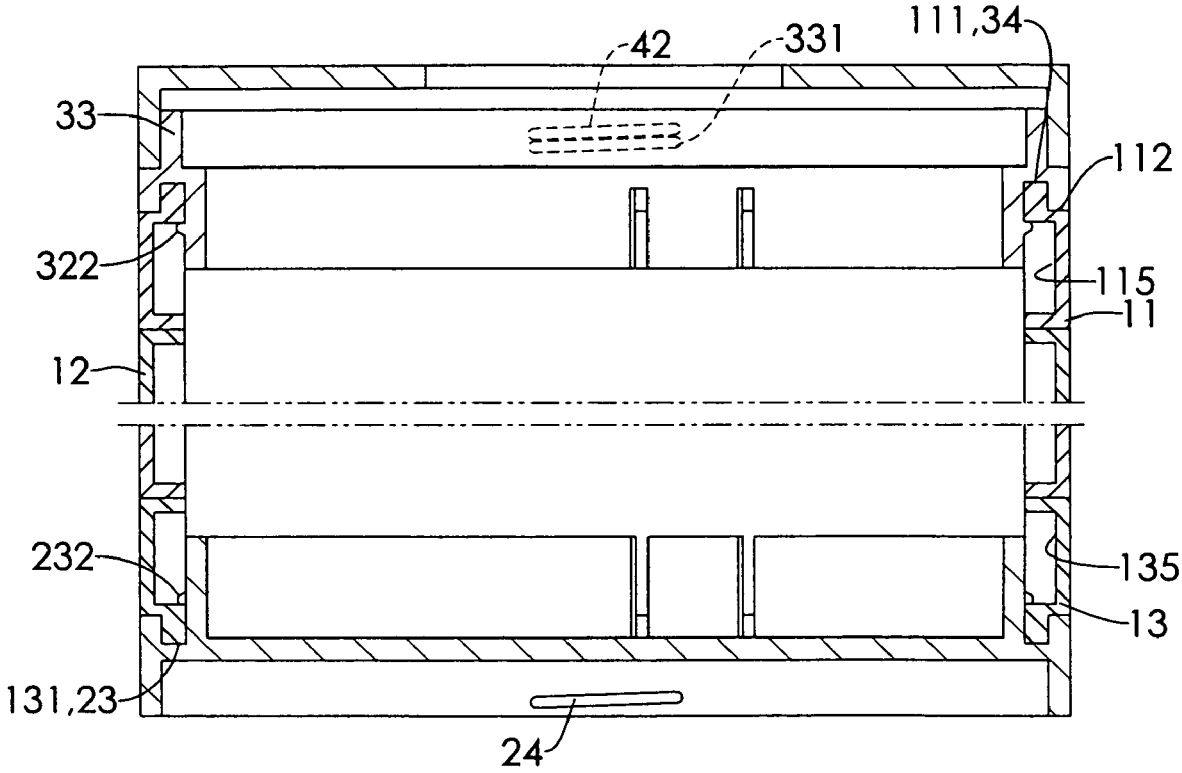
FIG. 4 is a schematic cross sectional view showing the combination among the top puzzle piece, the mediate puzzle piece and the bottom puzzle piece.
Figure 5:
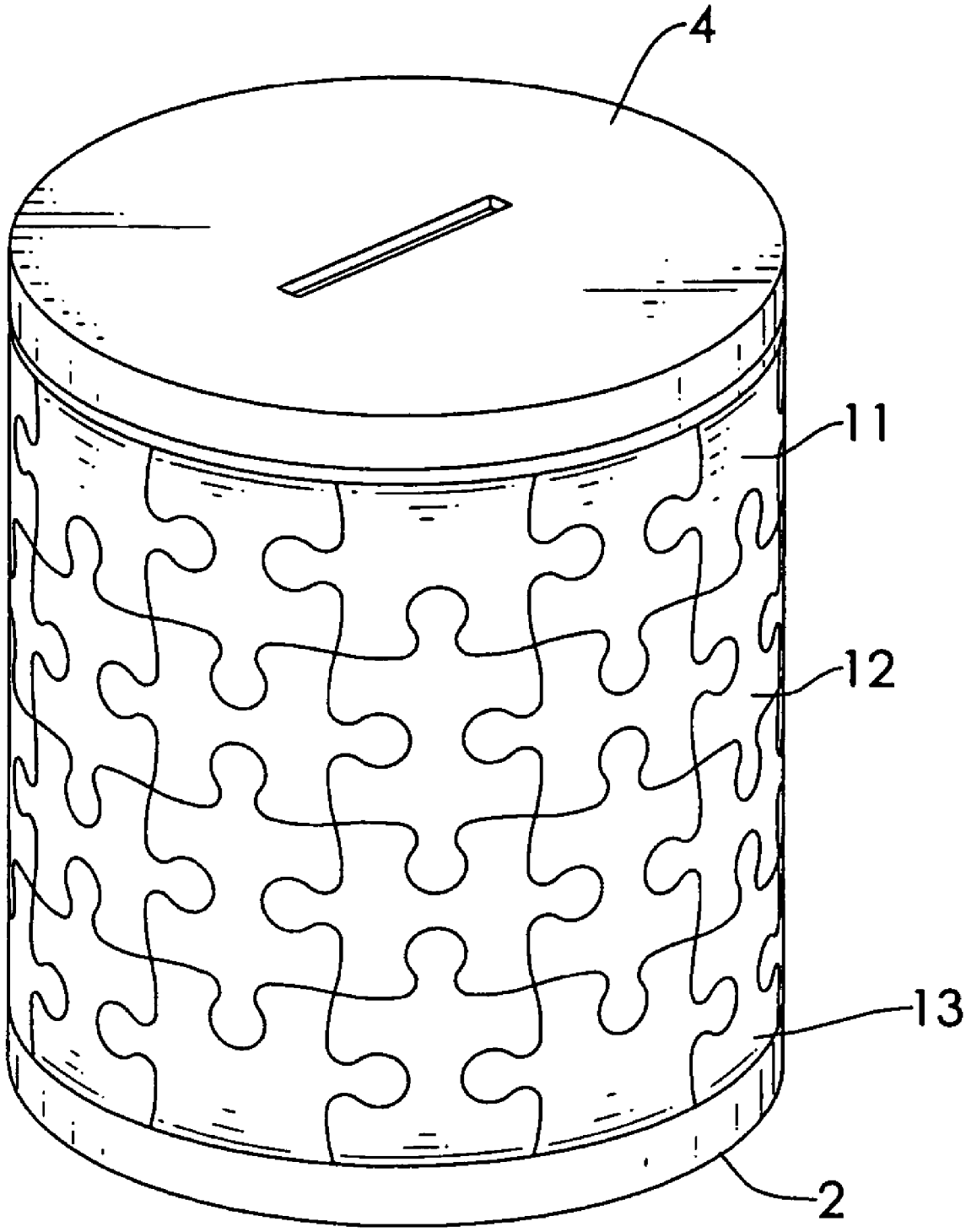
FIG. 5 is a perspective view showing the first embodiment of the present invention.

With reference to FIG. 4, when the cylindrical jigsaw puzzle of the present invention is assembled, it is noted that in addition to the correlation between the connection arm (113) and the cutout (114), the assembly edge (111) of each top puzzle piece (11) is inserted into the second gap (34) and the positioning ribs (322) are abutted to a bottom face defining the recessed area (115) and opposite to the assembly edge (111) such that the structural strength of the top puzzle pieces (11) is enhanced. Furthermore, in addition to the correlation between the connection arm (133) and the cutout (134), the assembly edge (131) of each bottom puzzle piece (13) is inserted into the first gap (23) and the bosses (232) are abutted to a bottom face defining the recessed area (135) and opposite to the assembly edge (131) such that the structural strength of the bottom puzzle pieces (13) is enhanced. Still, the step (112,132) of the top puzzle piece (11) and the bottom puzzle piece (13) are respectively abutted to a bottom peripheral edge of the ring body (31) and the outer flange (21). Thereafter, with the combination between the first securing ribs (331) and the second securing ribs (42), the cap (4) is securely mounted on top of the top rim (3), as shown in FIG. 5. Thus the user is able to use the structure as shown as a money box.

Figure 6:
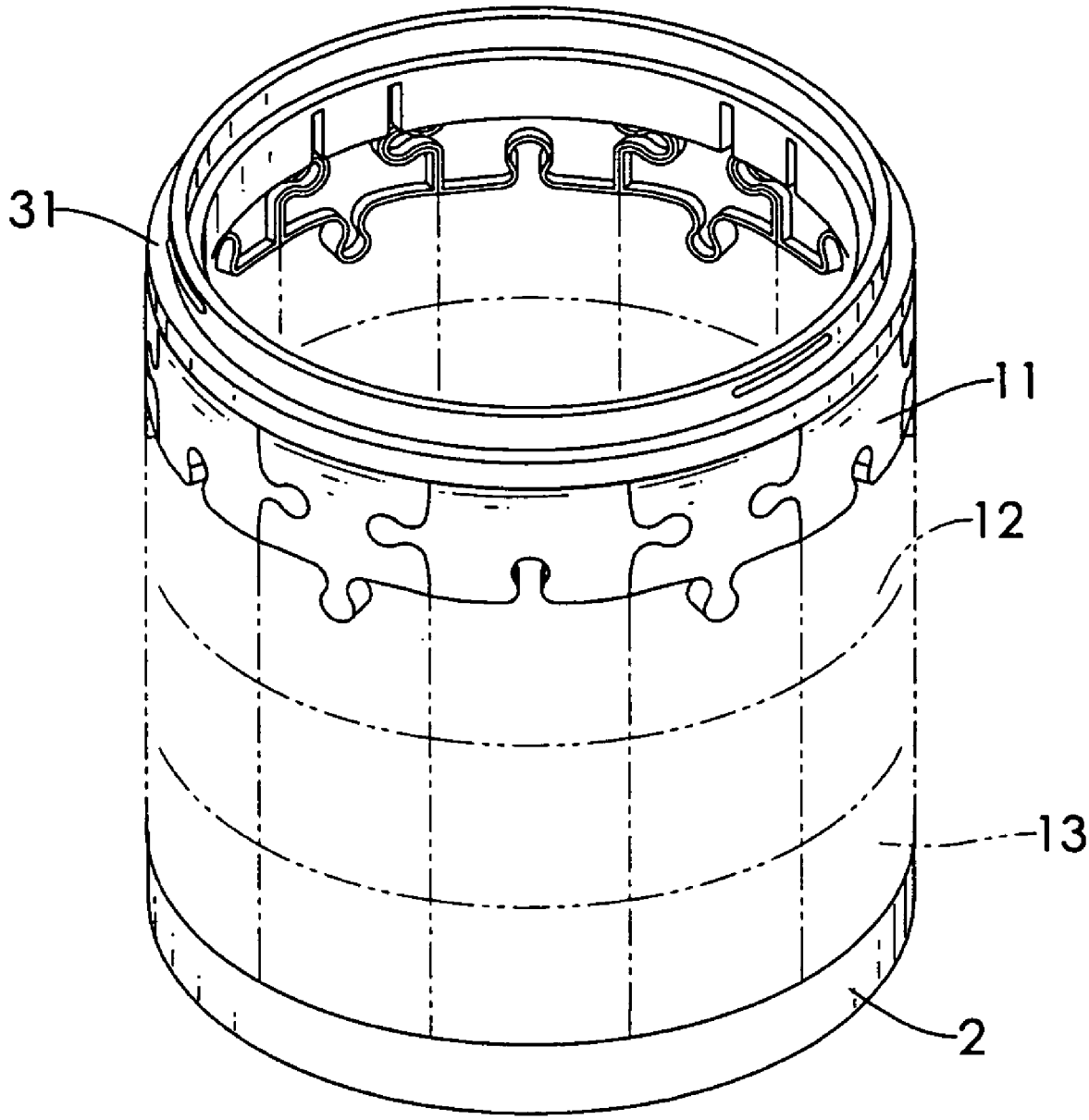
FIG. 6 is a perspective view showing the second embodiment of the present invention.

With reference to FIG. 6, after the cap (4) is removed, the user is able to use the cylindrical jigsaw puzzle of the present invention as a pen container.

Further, it is noted that without the assistance of the mediate puzzle pieces (12), the cylindrical jigsaw puzzle can still be assembled. That is, the connection arms (113) of the top puzzle piece (11) are complementary to the cutout (134) of the bottom puzzle piece (13) and the cutouts (114) of the top puzzle pieces (11) are complementary to the connection arms (133) of the bottom puzzle pieces (13) such that the combination between the connection arms (113,133) and the cutouts (114,134) among the top puzzle pieces (11) and the bottom puzzle pieces (13) is able to establish the cylinder. After the mounting of the top ring (3), the bottom rim (2) and the cap (4) on top of the top ring (3), the cylindrical jigsaw puzzle is accomplished.

Figure 7:
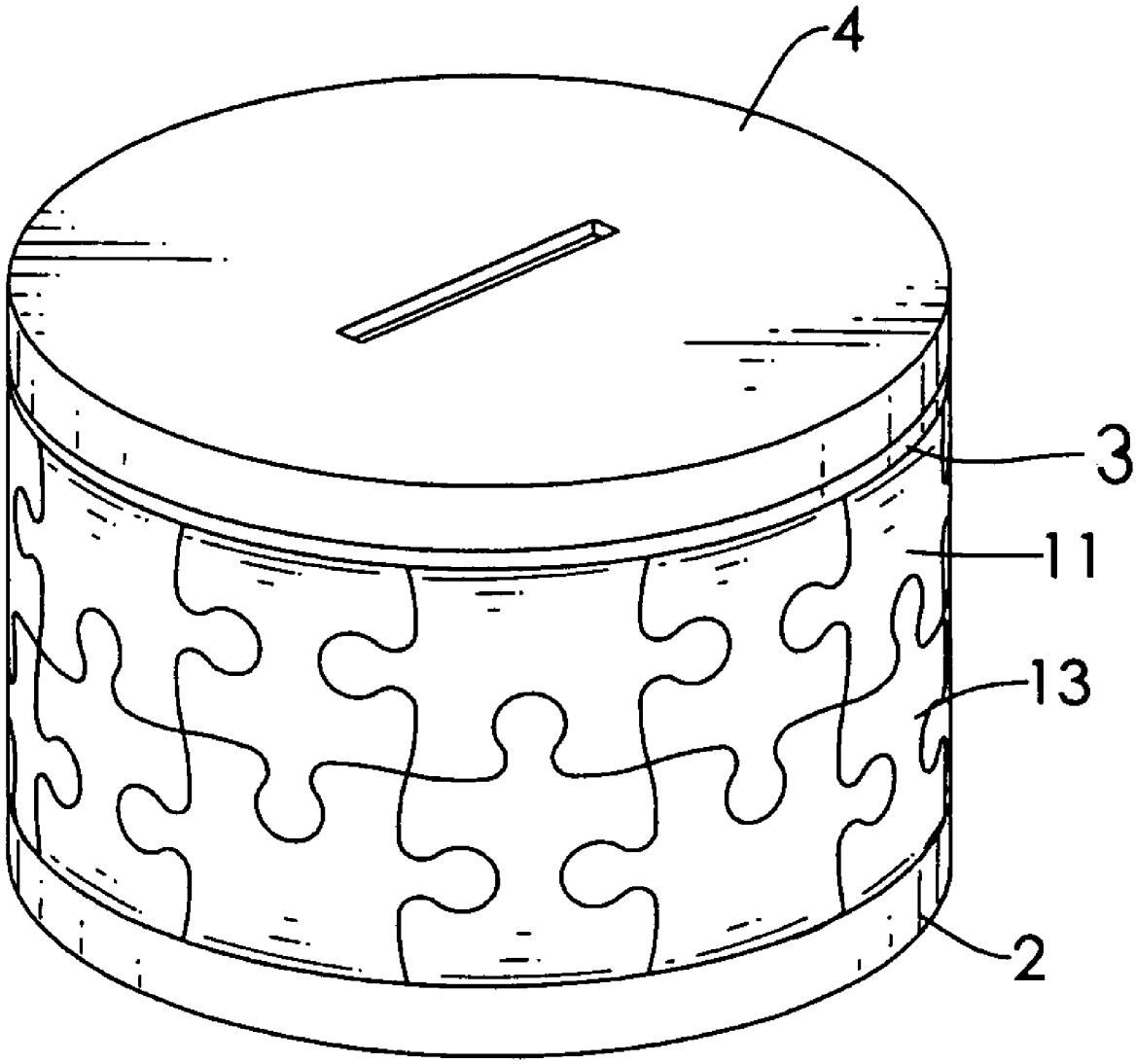
FIG. 7 is a perspective view showing the third embodiment of the present invention.
Figure 8:
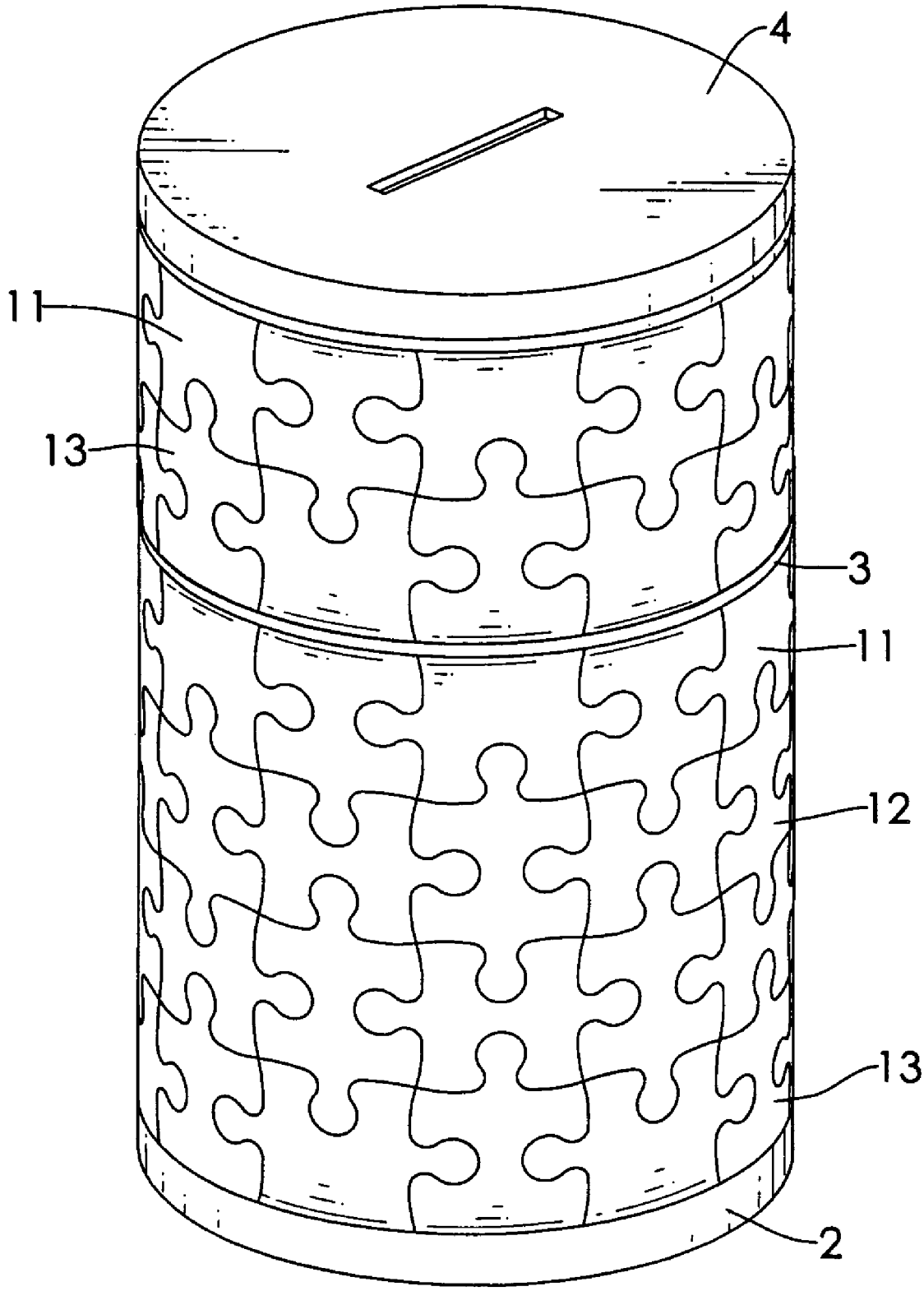
FIG. 8 is a perspective view showing a fourth embodiment of the present invention.

With reference to FIG. 8, it is noted that the user may directly employ the structure as shown in FIG. 7 to the structure as shown in FIG. 6 after the bottom rim (2) in FIG. 7 is removed. That is, the top rim (3) is used to combine the top puzzle pieces (11) and bottom puzzle pieces (13).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cylindrical jigsaw puzzle comprising:

a bottom rim having an outer flange, an inner flange integrally formed with the outer flange and a first gap defined between the outer flange and the inner flange;

a top rim having a ring body, a positioning flange extending from an inner face of the ring body and a second gap defined between the ring body, the positioning flange and multiple positioning pieces formed on the positioning flange to retain the top puzzle pieces;

top puzzle pieces each having a first assembly edge corresponding to and received in the second gap of the top rim, a first step formed on a face adjacent to the assembly edge to abut a peripheral edge of the ring body, two connection arms respectively extending from two opposed sides of the top puzzle piece and a cutout defined in a side face opposed to the side face where the assembly edge is formed to be complementary to the connection arm; and bottom puzzle pieces each having a second assembly edge corresponding to and received in the first gap of the bottom rim, a second step formed on a face adjacent to the second assembly edge to abut a peripheral edge of the outer flange, two connection arms respectively extending from two opposed sides of the bottom puzzle piece and a cutout defined in a side face opposed to the side face where the second assembly edge is formed to be complementary to the connection arm of the bottom puzzle piece, characterized in that each of the top puzzle pieces and of the bottom puzzle pieces has a recessed area defined in a rear side face thereof and each positioning piece has a positioning rib formed on an outer face thereof so that after the first assembly edge of the top puzzle piece is inserted into the second gap of the top rim, the positioning ribs on the positioning pieces are able to retain the top puzzle pieces.

2. The cylindrical jigsaw puzzle as claimed in claim 1 further comprising mediate puzzle pieces sandwiched between the top puzzle pieces and bottom puzzle pieces and each mediate puzzle piece having two extension arms respectively formed on two opposed sides thereof to be complementary to the cutouts of the top puzzle pieces and the bottom puzzle pieces and two connection cutouts respectively defined in two opposed sides thereof to be complementary to the connection arms of the top puzzle pieces and the bottom puzzle pieces.

3. The cylindrical jigsaw puzzle as claimed claim 1, wherein the bottom rim has multiple clamping pieces formed on the inner flange and each clamping piece has a boss formed on an outer face thereof such that after the second assembly edge is inserted into the first gap of the bottom rim, the bosses on the clamping pieces are able to retain the bottom puzzle pieces.

4. The cylindrical jigsaw puzzle as claimed in claim 2, wherein the bottom rim has multiple clamping pieces formed on the inner flange and each clamping piece has a boss formed on an outer face thereof such that after the second assembly edge is inserted into the first gap of the bottom rim, the bosses on the clamping pieces are able to retain the bottom puzzle pieces.

5. The cylindrical jigsaw puzzle as claimed in claim 3 further comprising multiple mediate puzzle pieces each having two extension arms oppositely formed on two opposed sides thereof to be complementary to the cutouts of the top puzzle pieces and the bottom puzzle pieces and connection cutouts oppositely defined in two opposed sides thereof to be complementary to the connection arms of the top puzzle pieces and the bottom puzzle pieces, wherein the top rim further has an extension flange extending upward from the inner face of the ring body to be opposite to the positioning flange and first securing ribs formed on an outer periphery of the extension flange to be oblique to a central axis of the top rim and to correspond to second securing ribs formed on an inner face of a cap which has an elongated hole defined therethrough and to be oblique to a central axis of the cap such that combination between the first securing ribs and second securing ribs is able to secure the cap on top of the top rim.

6. The cylindrical jigsaw puzzle as claimed in claim 4 further comprising multiple mediate puzzle pieces each having two extension arms oppositely formed on two opposed sides thereof to be complementary to the cutouts of the top puzzle pieces and the bottom puzzle pieces and connection cutouts oppositely defined in two opposed sides thereof to be complementary to the connection arms of the top puzzle pieces and the bottom puzzle pieces, wherein the top rim further has an extension flange extending upward from the inner face of the ring body to be opposite to the positioning flange and first securing ribs formed on an outer periphery of the extension flange to be oblique to a central axis of the top rim and to correspond to second securing ribs formed on an inner face of a cap which has an elongated hole defined therethrough and to be oblique to a central axis of the cap such that combination between the first securing ribs and second securing ribs is able to secure the cap on top of the top rim.

7. The cylindrical jigsaw puzzle as claimed in claim 5, wherein each of the top puzzle pieces has a recessed area defined in a rear side face thereof and a thickness between a bottom face defining the recessed area to a top face of the first assembly edge is substantially the same as a distance between a bottom face of each of the positioning pieces to the positioning rib, and each of the bottom puzzle pieces has a recessed area defined in a rear side face thereof and a thickness between a bottom face defining the recessed area to a top face of the second assembly edge is substantially the same as a distance between a bottom face of each of the clamping pieces to the boss.

8. The cylindrical jigsaw puzzle as claimed in claim 6, wherein each of the top puzzle pieces has a recessed area defined in a rear side face thereof and a thickness between a bottom face defining the recessed area to a top face of the first assembly edge is substantially the same as a distance between a bottom face of each of the positioning pieces to the positioning rib, and each of the bottom puzzle pieces has a recessed area defined in a rear side face thereof and a thickness between a bottom face defining the recessed area to a top face of the second assembly edge is substantially the same as a distance between a bottom face of each of the clamping pieces to the boss.

* * * * *